US009329616B2

(12) United States Patent
Mueller et al.

(10) Patent No.: US 9,329,616 B2
(45) Date of Patent: May 3, 2016

(54) OPERATING ELEMENT, PARTICULARLY FOR A MOTOR VEHICLE

(71) Applicant: AUDI AG, Ingolstadt (DE)

(72) Inventors: Ulrich Mueller, Ingolstadt (DE); Johann Schneider, Wettstetten (DE); Manfred Mittermeier, Altmannstein (DE)

(73) Assignee: AUDI AG, Ingolstadt (DE)

( * ) Notice: Subject to any disclaimer, the term of this patent is extended or adjusted under 35 U.S.C. 154(b) by 0 days.

(21) Appl. No.: 14/381,724

(22) PCT Filed: Jan. 26, 2013

(86) PCT No.: PCT/EP2013/000233

§ 371 (c)(1),
(2) Date: Aug. 28, 2014

(87) PCT Pub. No.: WO2013/127484

PCT Pub. Date: Sep. 6, 2013

(65) Prior Publication Data

US 2015/0020630 A1 Jan. 22, 2015

(30) Foreign Application Priority Data

Mar. 1, 2012 (DE) ..... 10 2012 004 116

(51) Int. Cl.

| | |
|---|---|
| ***G05G 9/047*** | (2006.01) |
| ***G05G 1/04*** | (2006.01) |
| ***G05G 5/05*** | (2006.01) |
| ***G05G 1/02*** | (2006.01) |
| ***G05G 1/08*** | (2006.01) |

(52) U.S. Cl.

CPC ..... *G05G 1/04* (2013.01); *G05G 1/025* (2013.01); *G05G 1/08* (2013.01); *G05G 5/05* (2013.01); *G05G 9/047* (2013.01); *G05G 2009/04714* (2013.01); *Y10T 74/20201* (2015.01)

(58) Field of Classification Search

USPC ..... 200/335; 700/85; 74/471 XY

See application file for complete search history.

(56) References Cited

U.S. PATENT DOCUMENTS

| | | | |
|---|---|---|---|
| 4,101,863 | A | 7/1978 | Lewicki |
| 4,962,448 | A | 10/1990 | DeMaio et al. |

(Continued)

FOREIGN PATENT DOCUMENTS

| | | |
|---|---|---|
| CN | 101292206 | 10/2008 |
| DE | 10 2005 057 023 A1 | 1/2007 |

(Continued)

OTHER PUBLICATIONS

Search Report issued Oct. 26, 2012 for corresponding German Patent Application No. 10 2012 004 116.0.

(Continued)

*Primary Examiner* — William C Joyce
*Assistant Examiner* — Randell J Krug
(74) *Attorney, Agent, or Firm* — Staas & Halsey LLP

(57) ABSTRACT

An operating element, particularly for a motor vehicle, has a rotary actuator rotatable about a first axis and pivotable about at least one second axis, the rotary actuator being arranged on a rotary actuator support. The rotary actuator support is acted on by a rocker lever with a pretensioning force opposing a pivoting movement of the rotary actuator, and the rotary actuator can only be pivoted about the second axis after overcoming the pretensioning force.

16 Claims, 6 Drawing Sheets

(56) References Cited

U.S. PATENT DOCUMENTS

| | | | | |
|---|---|---|---|---|
| 5,675,359 | A * | 10/1997 | Anderson | G05G 9/047 200/6 R |
| 6,227,066 | B1 | 5/2001 | Stachniak | |
| 2008/0223703 | A1 | 9/2008 | Schelbert et al. | |
| 2009/0008233 | A1 * | 1/2009 | Saomoto | G05G 5/05 200/6 A |

FOREIGN PATENT DOCUMENTS

| | | | | |
|---|---|---|---|---|
| DE | 10 2006 014 923 | A1 | 10/2007 | |
| DE | 10 2006 037 727 | A1 | 2/2008 | |
| DE | 10 2008 060 114 | A1 | 6/2010 | |
| DE | 10 2012 004 116.0 | | 3/2012 | |
| EP | 0 110 147 | A1 | 6/1984 | |
| FR | 1081821 | A * | 12/1954 | B66C 13/56 |
| WO | WO 83/00398 | A1 | 2/1983 | |
| WO | WO 2007/112865 | A1 | 10/2007 | |
| WO | PCT/EP2013/000233 | | 1/2013 | |

OTHER PUBLICATIONS

International Search Report mailed Sep. 13, 2013 for corresponding International Patent Application No. PCT/EP2013/000233.

WIPO provided English translation of the International Preliminary Report on Patentability uploaded on the WIPO website on Sep. 1, 2014 for corresponding International Patent Application No. PCT/EP2013/000233.

Chinese Office Action for related Chinese Patent Application No. 201380009033.6, issued Apr. 1, 2015, 5 pages.

* cited by examiner

OPERATING ELEMENT, PARTICULARLY FOR A MOTOR VEHICLE

CROSS REFERENCE TO RELATED APPLICATIONS

This application is based on and hereby claims priority to International Application No. PCT/EP2013/000233 filed on Jan. 26, 2013 and German Application No. 10 2012 004 116.0 filed on Mar. 1, 2012, the contents of which are hereby incorporated by reference.

BACKGROUND

The invention relates to an operator control, particularly for a motor vehicle, comprising a rotary actuator which can rotate about a first axis, can pivot about at least a second axis and is arranged on a rotary actuator support.

Such operator controls which have a rotary actuator are frequently used for user inputs if different functions are to be concealed by a single operator control.

A rotary actuator is typically of cylindrical design and its axis of symmetry is at the same time the rotational axis. Manually rotating the rotary actuator causes switching signals to be generated which can control a menu, for example of a navigation device or of a car radio. Such a user interface, which can be activated by a rotary actuator, is also referred to as a multimedia interface (MMI).

Rotary actuators can also be embodied as push and turn actuators, and in this variant a switching signal can be generated by an axial force, for example in order to confirm a menu item selected by turning the rotary actuator.

Recently, rotary actuators with further functions have been used. In the case of a rotary actuator used by the applicant, a tilting function is additionally provided, i.e. manual deflection of the rotary actuator to the left or right, in order to switch incrementally from one menu item to the next. This advancing switching function, which is also referred to as a skipping function, is implemented by deflection of the rotary actuator to the left or the right by a few degrees angle. After the deflection, the released rotary actuator moves back automatically into the zero position. In order to give a sensation of high quality, this zero position must be very stable and virtually rigid. In this way, a large number of functions can be implemented with a single rotary actuator. For example, the tilting to one side can trigger switching to the next radio transmitter and tilting in the opposite direction can trigger switching to a preceding radio transmitter. By rotating the rotary actuator it is possible to increase or reduce the volume. Briefly pressing can switch the sound off or on. Pressing for a long time can switch the radio off or on.

DE 10 2008 060 114 A1 discloses a multifunction operator control which is embodied as a push and turn actuator. Linear spring elements which are guided in tubes are provided under a cover. Such guidance always requires play, and for this reason the multifunction operator control cannot be mounted free of play.

SUMMARY

One possible object is specifying an operator control which is mounted free of play.

The inventors propose an operator control of the type mentioned at the beginning in which a prestressing force acting counter to a pivoting movement of the rotary actuator is applied to the rotary actuator support by a rocker lever, and the rotary actuator cannot be pivoted about the second axis until after the prestressing force has been overcome.

The operator control device is based on the realization that a quasi-play-free rotary actuator can be implemented by virtue of the fact that lateral deflection does not start until a defined force threshold has been overcome. The rotary actuator is held prestressed about its zero position by a prestressing force and as a result is absolutely free of play and wobble-free. In contrast to all known conventional operator controls, in this way play and "wobbling" about the zero position can be avoided.

Within the scope of the proposal it is possible to provide that the rocker lever bears on the rotary actuator support in a linear or planar fashion. The rotary actuator and the rotary actuator support are expediently firmly connected to one another, wherein the rotary actuator is preferably embodied as a cylindrical operator control knob which is rotatably arranged on the rotary actuator support. The rotary actuator support is usually concealed in the installed state.

It is also possible to provide that the operator control has a spring element for generating the prestressing force acting on the rocker lever. The spring element is supported here at one end on a component fixed to the vehicle bodywork and at the other end to the rocker lever. Tilting or pivoting of the rotary actuator cannot be triggered until after the prestressing force has been overcome. The prestressing force therefore constitutes a force threshold which has to be overcome, as a result of which the zero position is absolutely free of play.

According to a first refinement of the operator control, the rotational axis of the rocker lever can be arranged coaxially with respect to the longitudinal axis of the rotary actuator support. In this variant, the rotational axis of the rocker lever is arranged parallel to the longitudinal axis of the rotary actuator support and the prestressing force which is transmitted by the rocker lever acts perpendicularly on the rotary actuator support.

In this context, it is favorable if the rocker lever of the operator control acts on the rotary actuator support above and below the second axis. As a result, the prestressing force can counteract a tilting movement in the two opposite directions.

According to one alternative refinement, the rocker lever can be arranged above or below the rotary actuator support. In this variant, the rocker lever also counteracts a pivoting movement about the second axis in the two opposite directions.

One development can be provided in which the rotary actuator can additionally be pivoted about a third axis which is perpendicular to the first and second axes. In this refinement, the rotary actuator cannot only be tilted in two opposite directions but additionally it can be tilted in two directions perpendicular thereto, i.e. the rotary actuator can be tilted or pivoted in 90° steps about its perpendicular axis.

If tilting about the third axis is provided, the operator control can have two rocker levers which apply a prestressing force to the rotary actuator support. The two rocker levers can preferably be rotated about rotational axes which are orthogonal with respect to one another. A spring element can act on each of the two rocker levers in order to generate the prestressing force.

In addition, the inventors propose a motor vehicle, and the motor vehicle has at least one operator control of the type described.

BRIEF DESCRIPTION OF THE DRAWINGS

These and other objects and advantages of the present invention will become more apparent and more readily appreciated from the following description of the preferred embodiments, taken in conjunction with the accompanying drawings of which.

DETAILED DESCRIPTION OF THE PREFERRED EMBODIMENT

Figure 1:
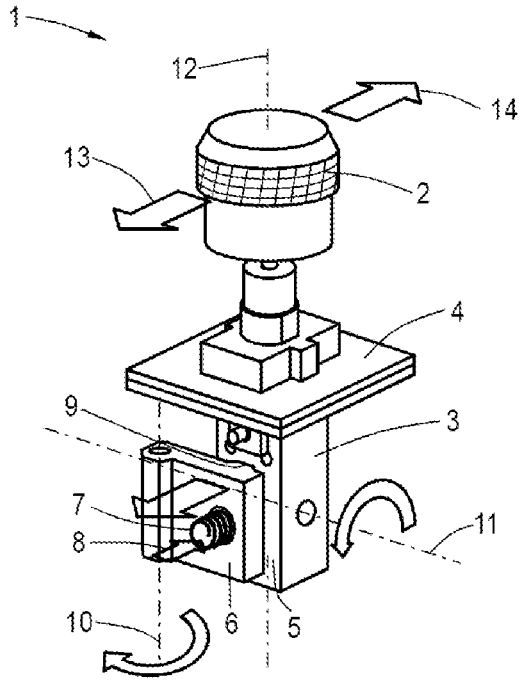
FIG. 1 shows a proposed operator control in a perspective view.

Reference will now be made in detail to the preferred embodiments of the present invention, examples of which are illustrated in the accompanying drawings, wherein like reference numerals refer to like elements throughout.

The operator control 1 shown in a perspective view in FIG. 1 comprises a rotary actuator 2 which is embodied as a cylindrical rotary knob and is permanently connected to a rotary actuator support 3. The rotary support 2 is rotatably mounted on the rotary actuator support 3, and during the manual rotation of the rotary actuator 2 switching signals are generated which are processed by a control device, as a result of which operator commands can be input. The operator control 1 comprises a cover 4, with the result that the rotary actuator support 3 is concealed in the installed state.

The rotary actuator support 3 is of square design, and a prestressing force is applied to a side faces of the rotary actuator support 3 by a rocker lever 6. The prestressing force is generated by a spring element 7 which is supported at one end on the vehicle bodywork or on a component connected thereto and at the other end on the rocker lever 6. An arrow 8 indicates the direction of the prestressing force generated by the spring element 7 and therefore acts orthogonally on the side face 5 of the rotary actuator support 3. As is shown in FIG. 1, the rocker lever 6 has a projection 9 on the side facing the rotary actuator support 3, with the result that the rocker lever 6 bears linearly on the rotary actuator support 3.

The rocker lever 6 can pivot about a rotational axis 10 which is arranged coaxially with respect to the longitudinal axis of the rotary actuator support 3. The rotary actuator support 3 can pivot about a rotational axis 11 which is orthogonal with respect thereto. In FIG. 1 it is apparent that the rocker lever 6 acts on the rotary actuator support 3 both above and below the rotational axis 11.

The rotary actuator 2 of the operator control 1 can rotate about its longitudinal axis 12 (first axis) and can pivot about the rotational axis 11 (second axis). Pivoting is possible in two opposite directions, which is symbolized by the two arrows 13, 14.

Figure 2:
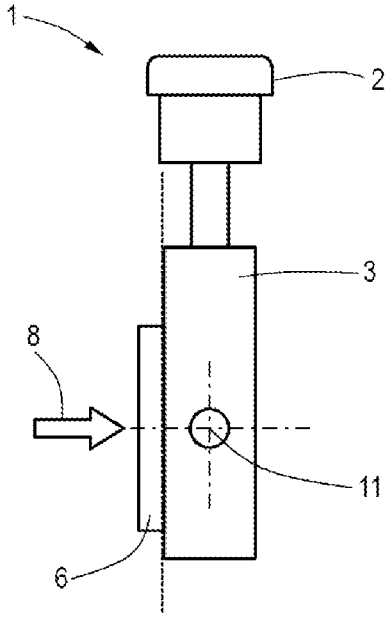
FIG. 2 shows a side view of the operator control shown in FIG. 1.

FIG. 2 shows the operator control 1 in a side view in which it is clear that the prestressing force generated by the spring element 7 is applied to the rotary actuator support 3 in the direction of the arrow 8 via the rocker lever 6, and in this way the prestressing force is applied to said rotary actuator support 3 in a linear form above and below the rotational axis 11 of said rotary actuator support 3.

Figure 3:
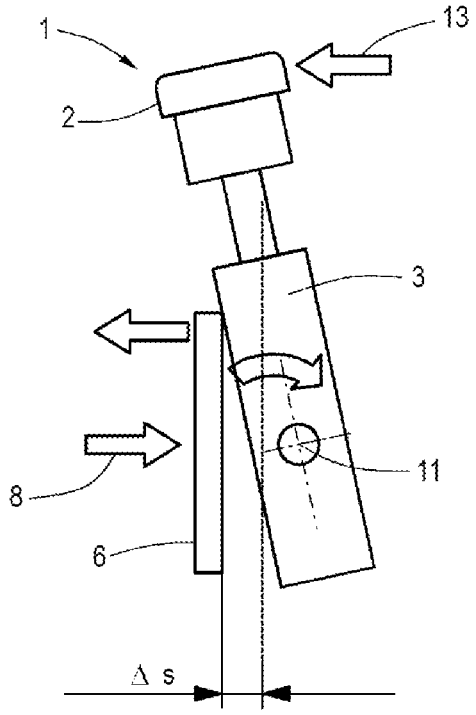
FIG. 3 shows the operator control from FIG. 1 in the deflected state.

FIG. 3 shows the operator control 1 during deflection in the direction of the arrow 13. If the user manually applies a force acting in the direction of the arrow 13 to the rotary actuator 2 and the rotary actuator support 3 connected thereto, the rotary actuator support 3 is pivoted about its rotational axis 11. The rotary actuator support 3 moves the rocker lever 6 laterally for a certain distance As. Before movement, the counteracting prestressing force firstly has to be overcome. The rotary actuator support 3 is therefore not pivoted until after a predefined force level, which can be set or adapted by the spring element 7, has been overcome. When the rotary actuator 2 is released, the operator control 1 turns back under the influence of the prestressing force, into its zero position shown in FIG. 2.

Figure 4:
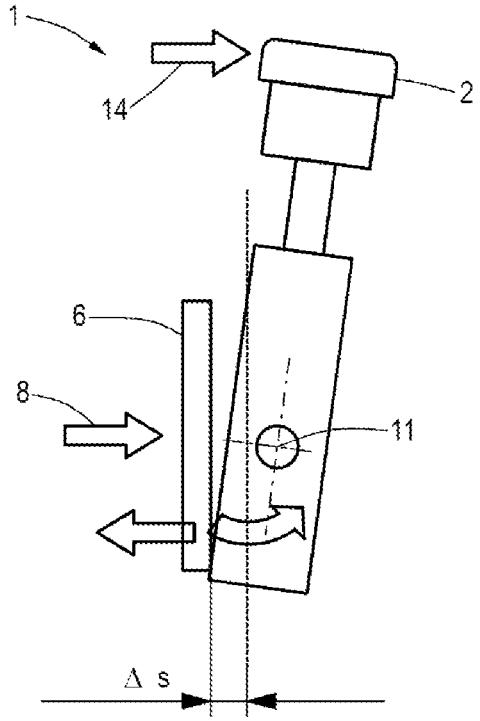
FIG. 4 shows the operator control from FIG. 1 in the case of the deflection in the opposite direction.

FIG. 4 shows the deflection of the operator control 1 in the opposite direction. If the rotary actuator 2 is moved in the direction of the arrow 14, the rotary actuator support 3 pivots about its rotational axis 11 and presses, with its lower part, the rocker lever 6 to the side, on the left in the view shown in FIG. 4. In this context, the prestressing force must firstly be overcome. In the zero position, the bearing is absolutely free of play since rotation or pivoting of the rotary actuator support 3 is not triggered until when the prestressing force is overcome.

Figure 5:
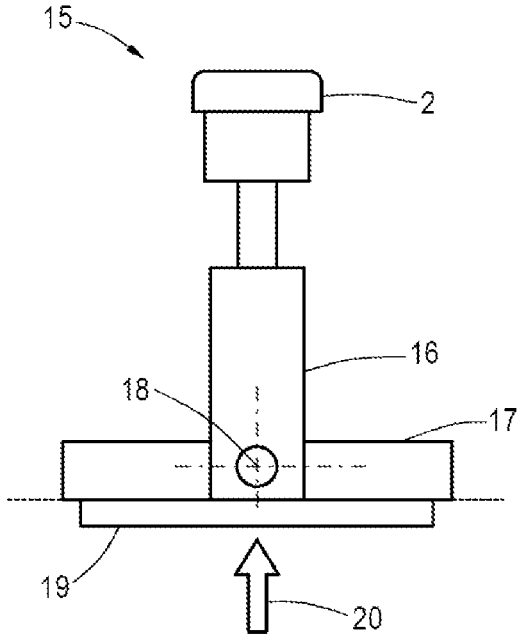
FIGS. 5 and 6 show a second exemplary embodiment of the proposed operator control.
Figure 6:
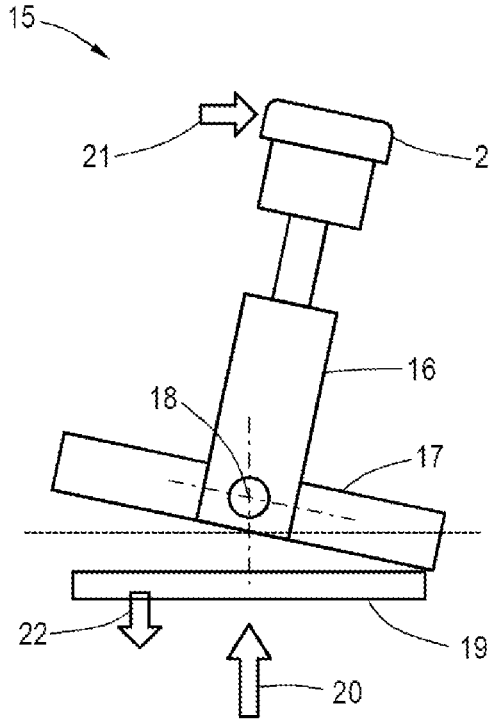

FIGS. 5 and 6 show a second exemplary embodiment of an operator control 15, wherein FIG. 5 shows the operator control in the zero position, and FIG. 6 shows the operator control in the deflected state.

In contrast to the preceding exemplary embodiment, the rotary actuator support 16 has a plate 17 on its underside, with the result that the rotary actuator support 16 which is permanently connected to the plate 17, can pivot about a horizontal rotational axis 18. A rocker lever 19 acts on the plate 17 on its underside, said rocker lever 19 generating a prestressing force which acts in the direction of the arrow 20.

As is shown in FIG. 6, the rotary actuator support 16 is pivoted about its rotational axis 18 during a deflection in the direction of the arrow 21, and in the process one end of the plate 17 presses the rocker lever 19 downward out of the zero position shown in FIG. 5, counter to the prestressing force in the direction of the arrow 22. However, the rotary actuator support 16 is not pivoted until after the force threshold, i.e. the prestressing force, has been overcome. The embodiment shown in FIGS. 5 and 6 therefore also has a play-free zero position.

Figure 7:
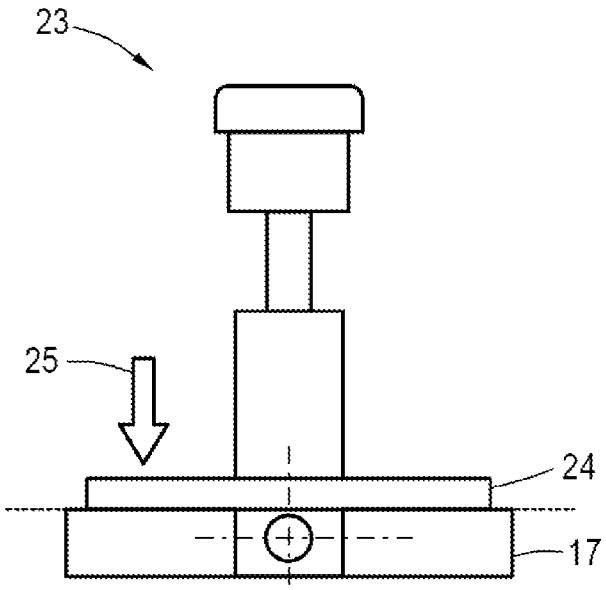
FIGS. 7 and 8 show a third exemplary embodiment of the proposed operator control.
Figure 8:
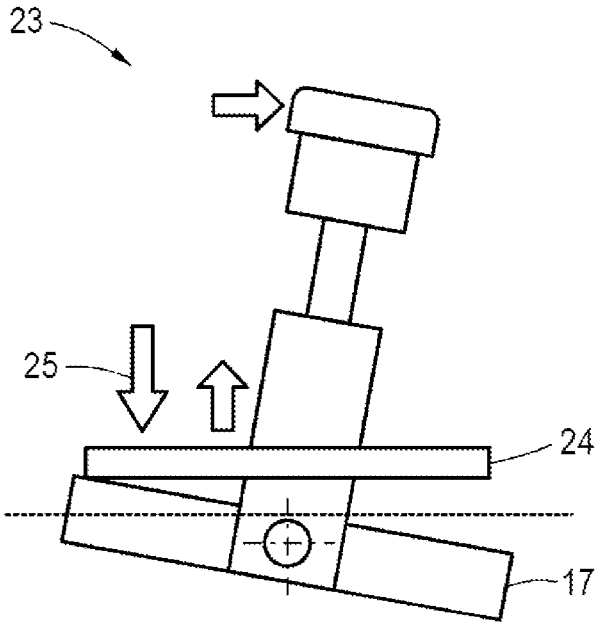

FIGS. 7 and 8 show a third exemplary embodiment of an operator control 23 which is of a similar design to the preceding exemplary embodiment. In contrast to this, the operator control 23 has, however, a rocker lever 24 which is arranged on the upper side of the plate 17. Accordingly, when the operator control 23 pivots out of the stable zero position counter to the restoring force 25, the rocker lever 24 is moved upward by the plate 17. The rocker lever 24 is concealed under a cover (not illustrated) here.

Figure 9:
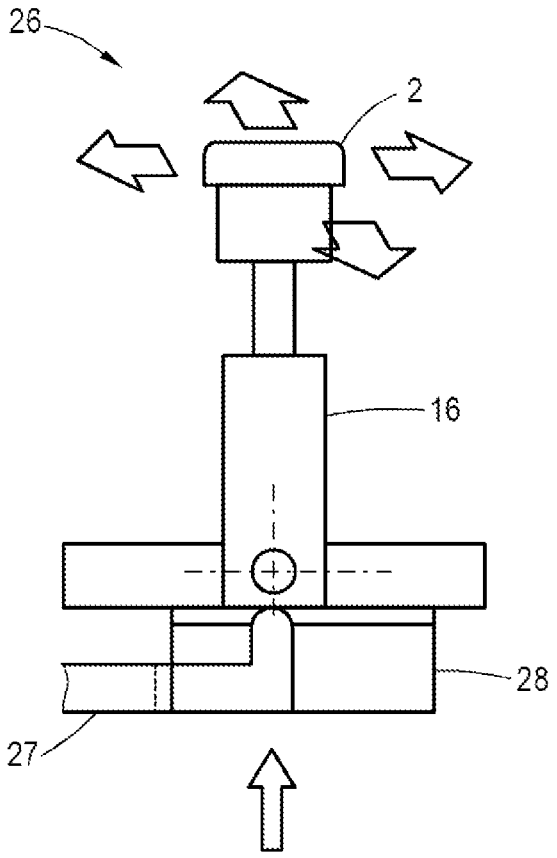
FIG. 9 shows a fourth exemplary embodiment of the proposed operator control.
Figure 10:
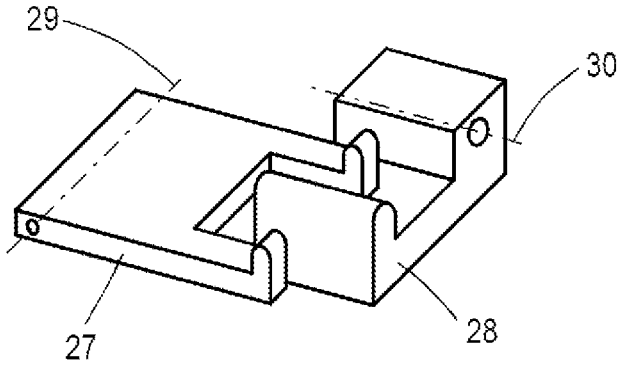
FIG. 10 shows the rocker levers of the operator control from FIG. 9.
Figure 11:
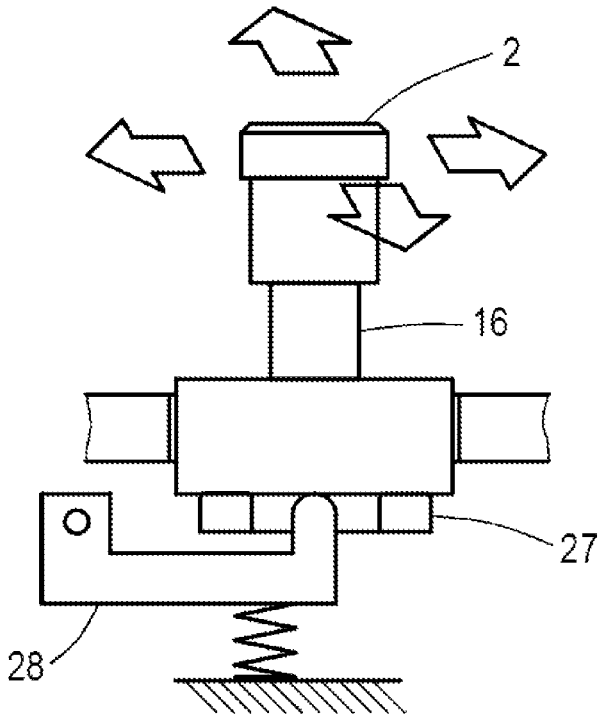
FIG. 11 shows a sectional side view through the operator control from FIG. 9.

FIGS. 9 to 11 show a fourth exemplary embodiment of an operator control 26 which is shown in a side view in FIG. 9. The rotary actuator 2 of the operator control 26 can, similarly to a joystick, be actuated in four directions which are each offset from one another by 90°. Two rocker levers 27, 28, which are shown in a perspective view in FIG. 10, are provided underneath the rotary actuator support 16. The two rocker levers 27, 28 can rotate about two rotational axes 29, 30 which are orthogonal with respect to one another. A spring element, which respectively generates a prestressing force, is applied to each rocker lever 27, 28.

The rocker levers 27, 28 are embodied in such a way that they can be activated independently of one another, i.e. when the rotary actuator 2 is activated in such a way that the rocker lever 27 is pivoted out of its zero position, the position of the other rocker lever 28 is not changed, and vice versa.

FIG. 11 shows the operator control 26 in a side view which is rotated through 90° with respect to the illustration in FIG. 9.

All the exemplary embodiments explained have in common the fact that the rocker lever which has the function of a pressing plate carries out a play-free linear movement by virtue of its rotational bearing. As a result, the zero position of the rotary actuator is absolutely free of play, as a result of which an impression of high quality is generated by the operator control.

The invention has been described in detail with particular reference to preferred embodiments thereof and examples, but it will be understood that variations and modifications can be effected within the spirit and scope of the invention covered by the claims which may include the phrase "at least one of A, B and C" as an alternative expression that means one or more of A, B and C may be used, contrary to the holding in *Superguide v. DIRECTV,* 69 USPQ2d 1865 (Fed. Cir. 2004).

The invention claimed is:

1. An operator control device for a motor vehicle, comprising:

a rotary actuator support having a longitudinal axis;

a rotary actuator which can rotate about a first axis, is arranged on the rotary actuator support and which can pivot together with the rotary actuator support about a second axis; and a rocker lever to rotate about a rotational axis and to apply a prestressing force acting counter to a pivoting movement of the rotary actuator such that the rotary actuator cannot be pivoted about the second axis until after the prestressing force has been overcome, the rotational axis of the rocker lever being arranged parallel to the longitudinal axis of the rotary actuator support when the rotary actuator is not pivoted about the second axis, wherein the rocker lever acts on the rotary actuator support above and below the second axis, and the longitudinal axis of the rotary actuator support is coaxial with the first axis.

2. The operator control device as claimed in claim 1, wherein the rocker lever bears on the rotary actuator support in a linear or planar fashion.

3. The operator control device as claimed in claim 1, wherein the rocker lever comprises a projection which is biased against the rotary actuator support, and the projection maintains at least line contact with the rotary actuator support when the rotary actuator is not pivoted about the second axis.

4. The operator control device as claimed in claim 1, wherein a spring element generates the prestressing force applied by the rocker lever.

5. The operator control device as claimed in claim 1, wherein the second axis is perpendicular to the longitudinal axis of the rotary actuator support and perpendicular to the rotational axis of the rocker lever, the rocker lever comprises a projection which is biased against a surface of the rotary actuator support, and the projection has a length which extends above and below the second axis such that a plane extending from the second axis intersects an intermediate portion along the length of the projection, the plane extending in a direction perpendicular to the rotational axis of the rocker lever.

6. The operator control device as claimed in claim 1, wherein the rotary actuator can additionally be pivoted about a third axis which is perpendicular to the first and second axes.

7. The operator control device as claimed in claim 1, wherein the second axis is perpendicular to the longitudinal axis of the rotary actuator support and perpendicular to the rotational axis of the rocker lever.

8. The operator control device as claimed in claim 1, wherein the second axis is perpendicular to the longitudinal axis of the rotary actuator support and perpendicular to the rotational axis of the rocker lever, the rocker lever comprises a projection which is biased against the rotary actuator support, the projection extends parallel to the longitudinal axis of the rotary actuator support when the rotary actuator is not pivoted about the second axis, and the projection extends parallel to the rotational axis of the rocker lever.

9. The operator control device as claimed in claim 1, wherein the second axis is perpendicular to the longitudinal axis of the rotary actuator support and perpendicular to the rotational axis of the rocker lever, the rocker lever comprises a projection which is biased against a surface of the rotary actuator support, and the surface of the rotary actuator support extends in a direction parallel to the longitudinal axis of the rotary actuator support.

10. The operator control device as claimed in claim 1, wherein the second axis is perpendicular to the longitudinal axis of the rotary actuator support and perpendicular to the rotational axis of the rocker lever, the rocker lever comprises a projection which is biased against a surface of the rotary actuator support, the surface of the rotary actuator support extends in first and second mutually orthogonal directions, the first direction is parallel the longitudinal axis of the rotary actuator support, and the second direction is parallel to the second axis.

11. A motor vehicle comprising:

an operator control device, the operator control device comprising:

a rotary actuator support having a longitudinal axis;

a rotary actuator which can rotate about a first axis, is arranged on the rotary actuator support and which can pivot together with the rotary actuator support about a second axis; and a rocker lever to rotate about a rotational axis and to apply a prestressing force acting counter to a pivoting movement of the rotary actuator such that the rotary actuator cannot be pivoted about the second axis until after the prestressing force has been overcome, the rotational axis of the rocker lever being arranged parallel to the longitudinal axis of the rotary actuator support when the rotary actuator is not pivoted about the second axis, wherein the rocker lever acts on the rotary actuator support above and below the second axis, and the longitudinal axis of the rotary actuator support is coaxial with the first axis.

12. The motor vehicle as claimed in claim 11, wherein the rocker lever bears on the rotary actuator support in a linear or planar fashion.

13. The motor vehicle as claimed in claim 11, wherein the rocker lever comprises a projection which is biased against the rotary actuator support, and the projection maintains at least line contact with the rotary actuator support when the rotary actuator is not pivoted about the second axis.

14. The motor vehicle as claimed in claim 11, wherein a spring element generates the prestressing force applied by the rocker lever.

15. The motor vehicle as claimed in claim 11, wherein the second axis is perpendicular to the longitudinal axis of the rotary actuator support and perpendicular to the rotational axis of the rocker lever, the rocker lever comprises a projection which is biased against a surface of the rotary actuator support, and the projection has a length which extends above and below the second axis such that a plane extending from the second axis intersects an intermediate portion along the length of the projection, the plane extending in a direction perpendicular to the rotational axis of the rocker lever.

16. The motor vehicle as claimed in claim 11, wherein the rotary actuator can additionally be pivoted about a third axis which is perpendicular to the first and second axes.

* * * * *